US006269665B1

(12) United States Patent
Wang

(10) Patent No.: US 6,269,665 B1
(45) Date of Patent: Aug. 7, 2001

(54) JACK AND UPPER NEEDLE DIAL FOR CIRCULAR KNITTING MACHINE AND DOUBLE-KNITTING PLUSH FABRIC FABRICATED BY THE SAME

(75) Inventor: Ping-Shin Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 09/785,491

(22) Filed: Feb. 20, 2001

(51) Int. Cl.[7] ..... D04B 15/06
(52) U.S. Cl. ..... 66/91; 66/107
(58) Field of Search ..... 66/8, 19, 91, 92, 66/93, 104, 25, 107, 31, 20, 23, 27, 217

(56) References Cited

U.S. PATENT DOCUMENTS 3,477,255 * 11/1969 Lombardi ..... 66/107
4,519,221 * 5/1985 Hirano ..... 66/107
4,955,211 * 9/1990 Neher ..... 66/107
5,511,393 * 4/1996 Hu ..... 66/93
5,775,132 * 7/1998 Lonati et al. ..... 66/107
6,089,047 * 7/2000 Wang ..... 66/91

* cited by examiner

*Primary Examiner*—Danny Worrell
(74) *Attorney, Agent, or Firm*—Bacon & Thomas, PLLC

(57) ABSTRACT

A jack and upper needle dial for circular knitting machine for fabricating double-knitting plush fabric includes an outer and inner curl sinker plate, an upper needle dial for holding the outer and inner curl sinker plate and a jack, and a sinker ring. The sinker ring may drive the outer and inner curl sinker plate to couple with a knitting needle to perform tucking and sinking loop operation for generating loop effect at both sides of the plush fabric. The outer and inner curl sinker plate may be moved smoothly in the jack without hitting the sinker ring and may prevent the sinker ring and outer and inner curl sinker plate from damaging.

1 Claim, 13 Drawing Sheets

JACK AND UPPER NEEDLE DIAL FOR CIRCULAR KNITTING MACHINE AND DOUBLE-KNITTING PLUSH FABRIC FABRICATED BY THE SAME

BACKGROUND OF THE INVENTION

This invention relates to a jack and upper needle dial for a circular knitting machine and the double-knitting plush fabric fabricated by the same, and particularly a jack and upper needle dial structure that is capable of generating loop effect at the inner and outer sides of the fabricated double-knitting plush fabric, and preventing sinker ring from hitting inner and outer sinker plates for avoiding damage of the sinker ring and inner and outer sinker plates.

Conventional knitting process for fabricating stitch loop on the double-knitting plush fabric surface generally includes: disposing individual sinker plate in circular fashion in the grooves of a sinker seat, activating the knitting machine and actuating a needle dial to drive a knitting needle to pick up an inner yarn, a ground yarn and an outer yarn, and moving the sinker plate forward and rearward for a displacement desired by means of a sinker ring to produce the double-knitting plush fabric. The stitch loop is formed through the sinker plate. A conventional sinker plate has a nose section, a throat section and a belly section. There is a notch formed between the throat and belly section. During knitting operation, the inner yarn falls onto the nose section, top yarn falls onto the belly section and outer yarn falls onto the notch. If control is focused on the stitch loop at the front side, the stitch loop generated at the rear side is not satisfactory. On the other hand, if the control is focused on the stitch loop at the rear side, the stitch loop generated at the front side is not satisfactory. Hence employing only one sinker plate to control fabrication of the stitch loops for double-knitting plush fabric cannot be done effectively by the presently adapted technique, and the resulting fabric has a relatively loose engagement between the outer curls and ground yarns.

Furthermore, the slide groove in the upper needle dial is formed by milling machine. After machining, the two lateral sides of the slide groove have rough surfaces. The sinker plate moves in the slide groove will be scraped and forms rough surfaces at two sides. As a result, the sinker plate is difficult to move smoothly when driven by the sinker ring. It could cause impact between the sinker plate and sinker ring and result in damage of the sinker ring, and deforming or breaking of the sinker plate, and might impact normal operation of the circular knitting machine.

SUMMARY OF THE INVENTION

It is therefore an object of this invention to control extending displacements of an outer sinker plate and inner sinker plate after the knitting of the double-knitting plush fabric to generate loops at both sides of the fabric.

Another object of this invention is to dispose a jack on the upper needle dial that has two lateral sides sandwiching the outer curl sinker plate and inner curl sinker plate therebetween so that the outer curl sinker plate and inner curl sinker plate may be moved and pushed forwards smoothly.

To attain the foregoing objects, this invention has mating guide paths in the sinker ring. When the outer and inner sinker plates have been pushed outwards by the sinker ring, they will couple with motion of the tucking loop and sinking loop of the knitting needle to produce inner and outer loop effect on the double-knitting plush fabric. The jack also may prevent the sinker ring from hitting the outer and inner sinker plate and avoid damage of the sinker ring and outer and inner sinker plate.

BRIEF DESCRIPTION OF THE DRAWINGS

The invention, as well as its many advantages, may be further understood by the following detailed description and drawings.

DESCRIPTION OF THE PREFERRED EMBODIMENT

Figure 1:
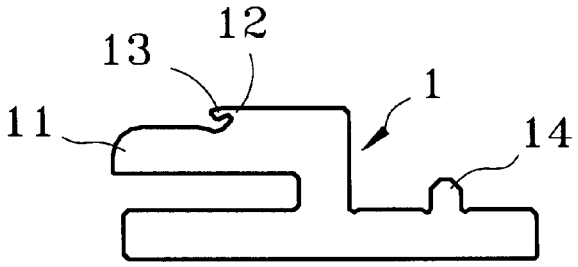
FIG. 1 is a schematic side view of an outer sinker plate of this invention.
Figure 2:
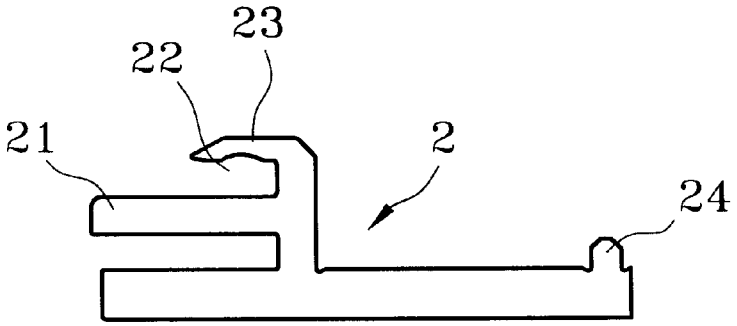
FIG. 2 is a schematic side view of an inner sinker plate of this invention.
Figure 3:
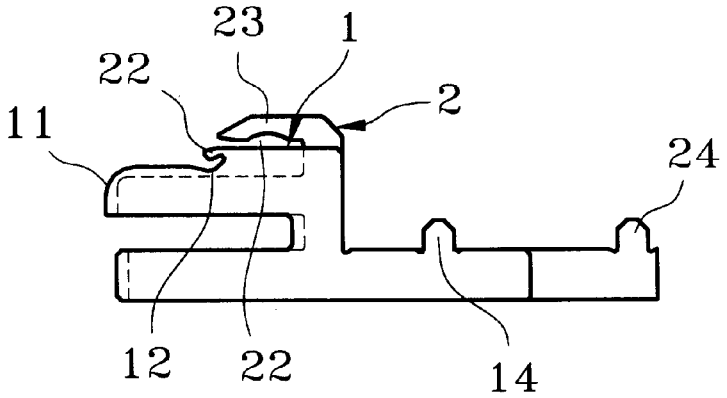
FIG. 3 is a schematic side view of a coupled outer and inner sinker plate according to FIGS. 1 and 2.
Figure 4:
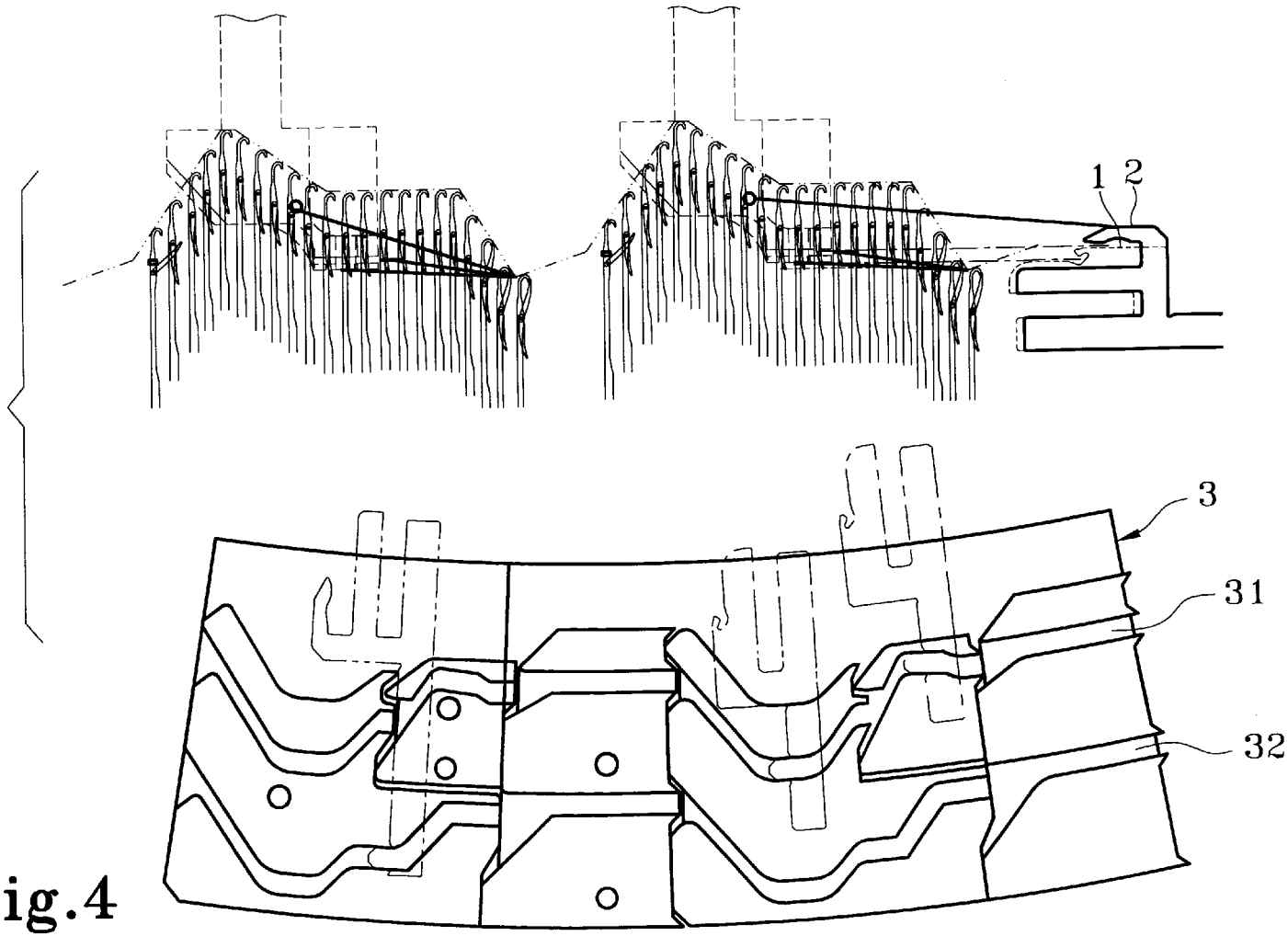
FIG. 4 is an extended schematic view of lower knitting needles, sinker ring, outer and inner curls sinker plates of this invention.
Figure 5:
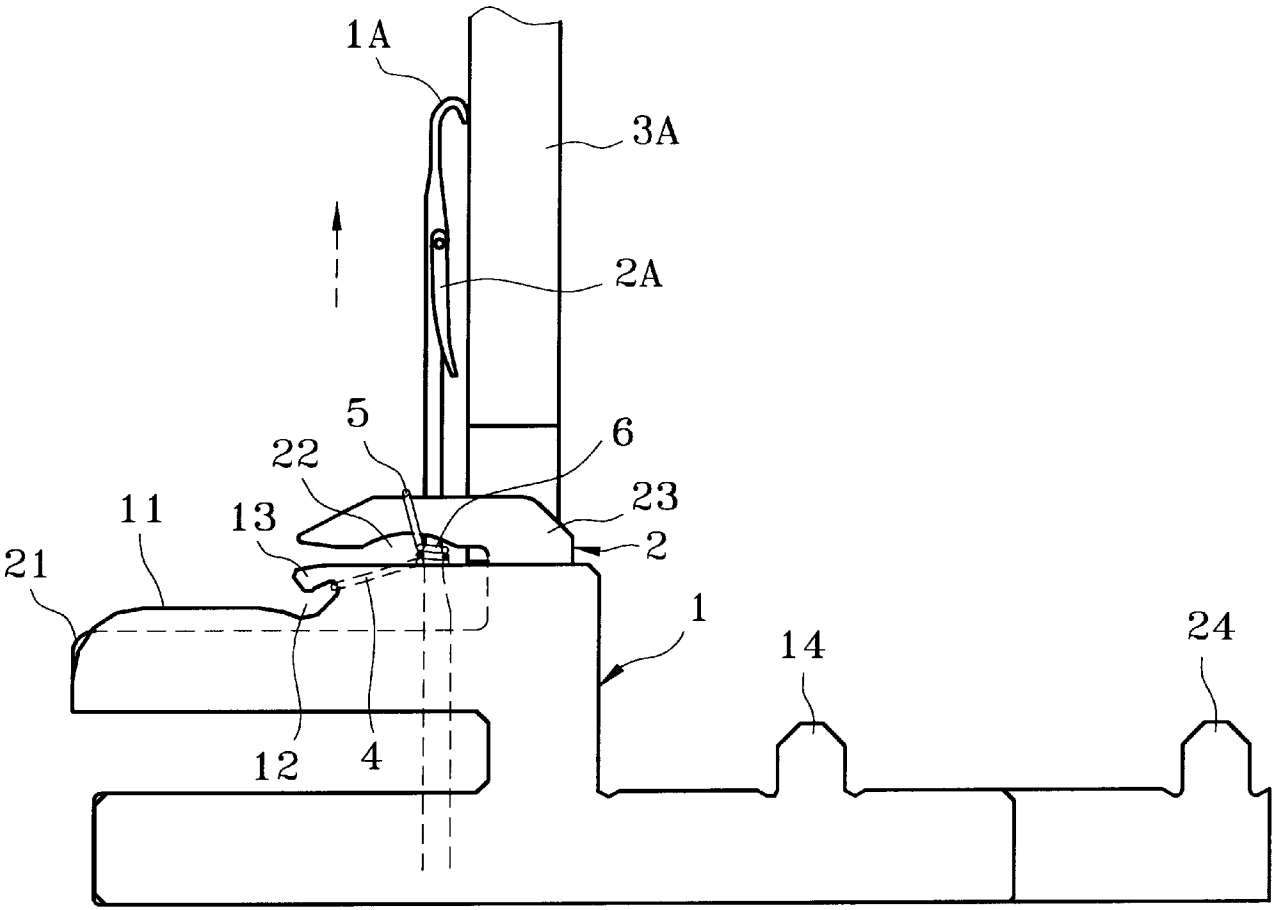
FIG. 5 is a schematic view of a first knitting step according to this invention.
Figure 6:
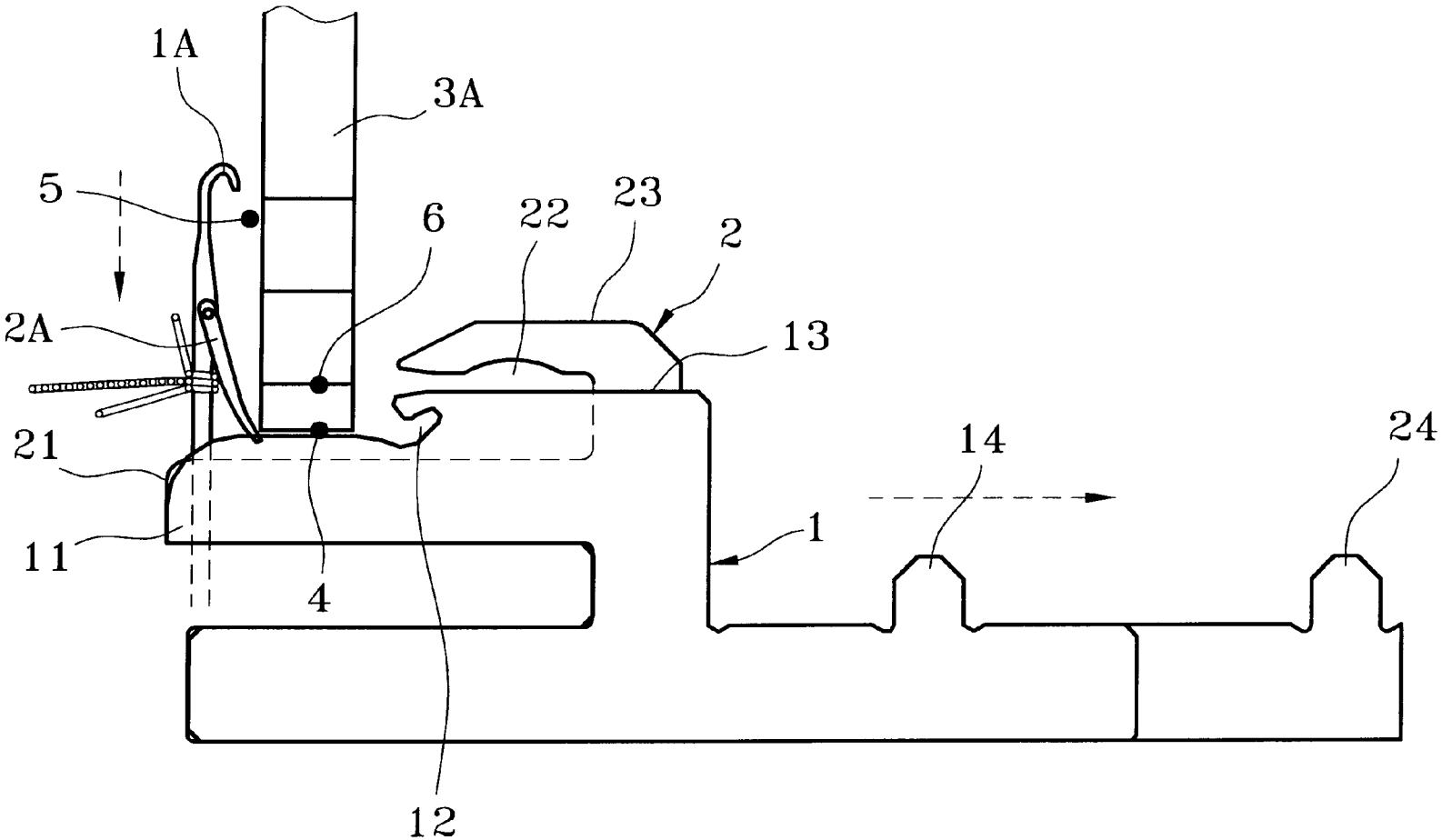
FIG. 6 is a schematic view of a second knitting step according to his invention.
Figure 7:
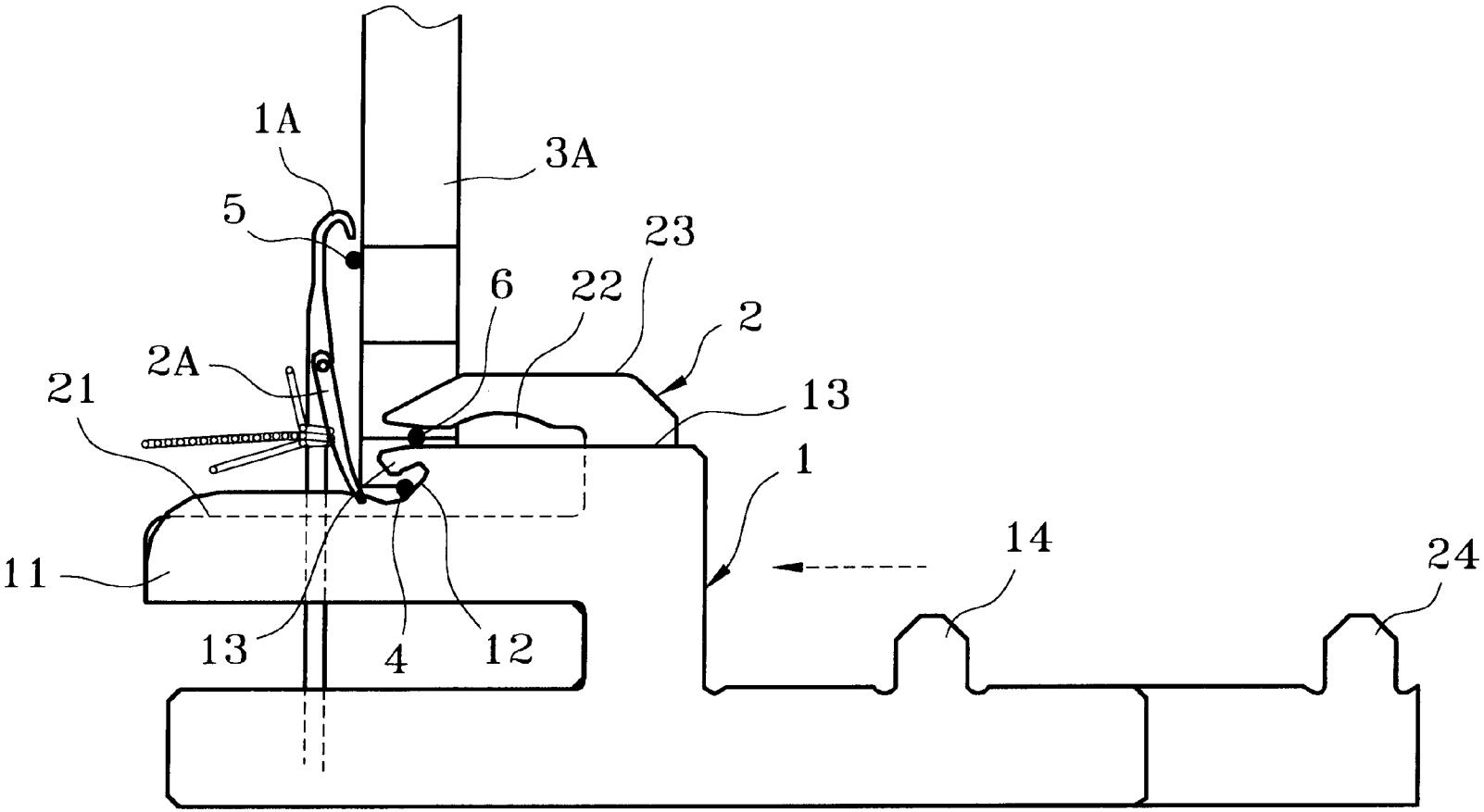
FIG. 7 is a schematic view of a third knitting step according to this invention.
Figure 8:
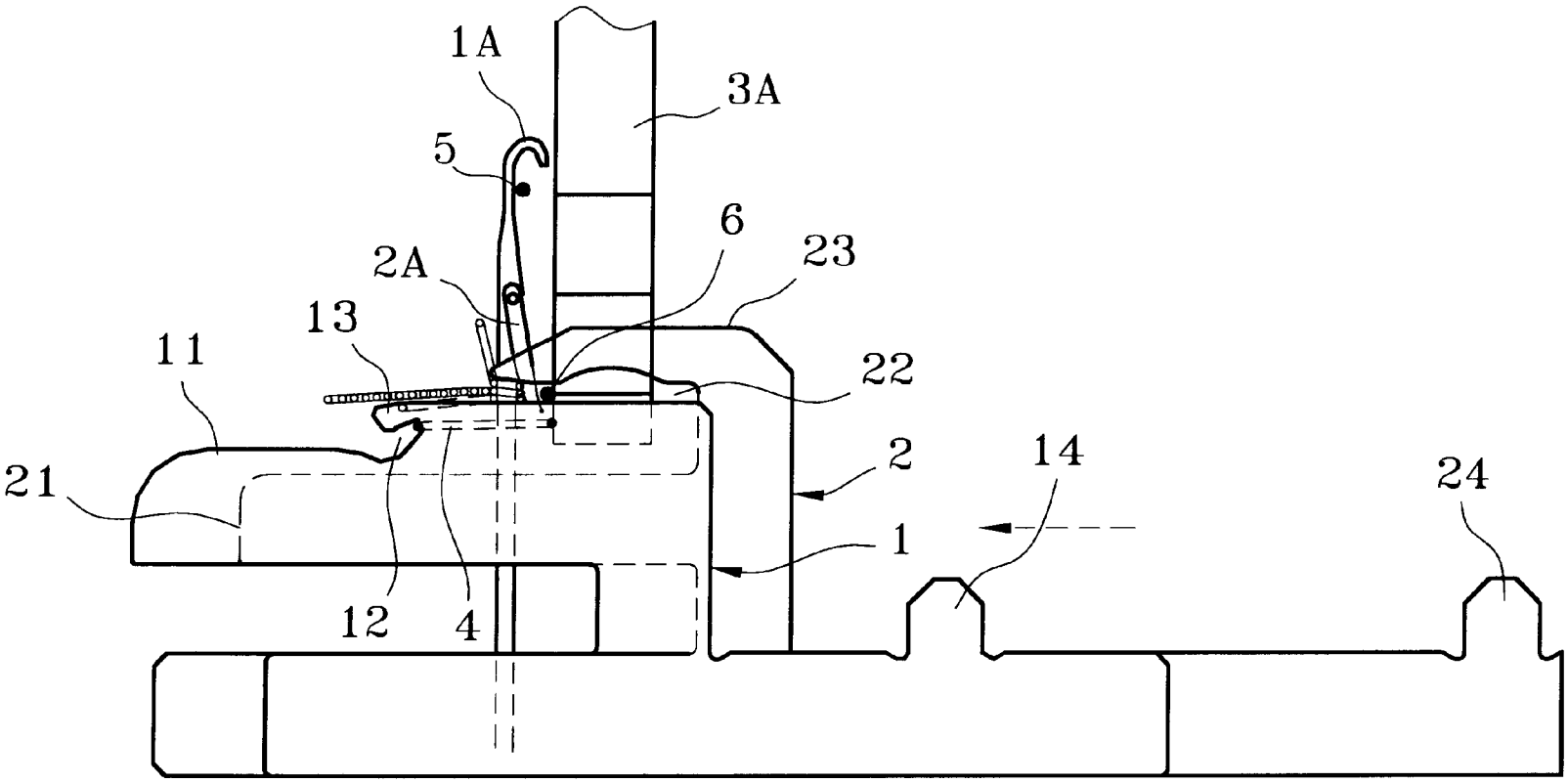
FIG. 8 is a schematic view of a fourth knitting step according to this invention.
Figure 9:
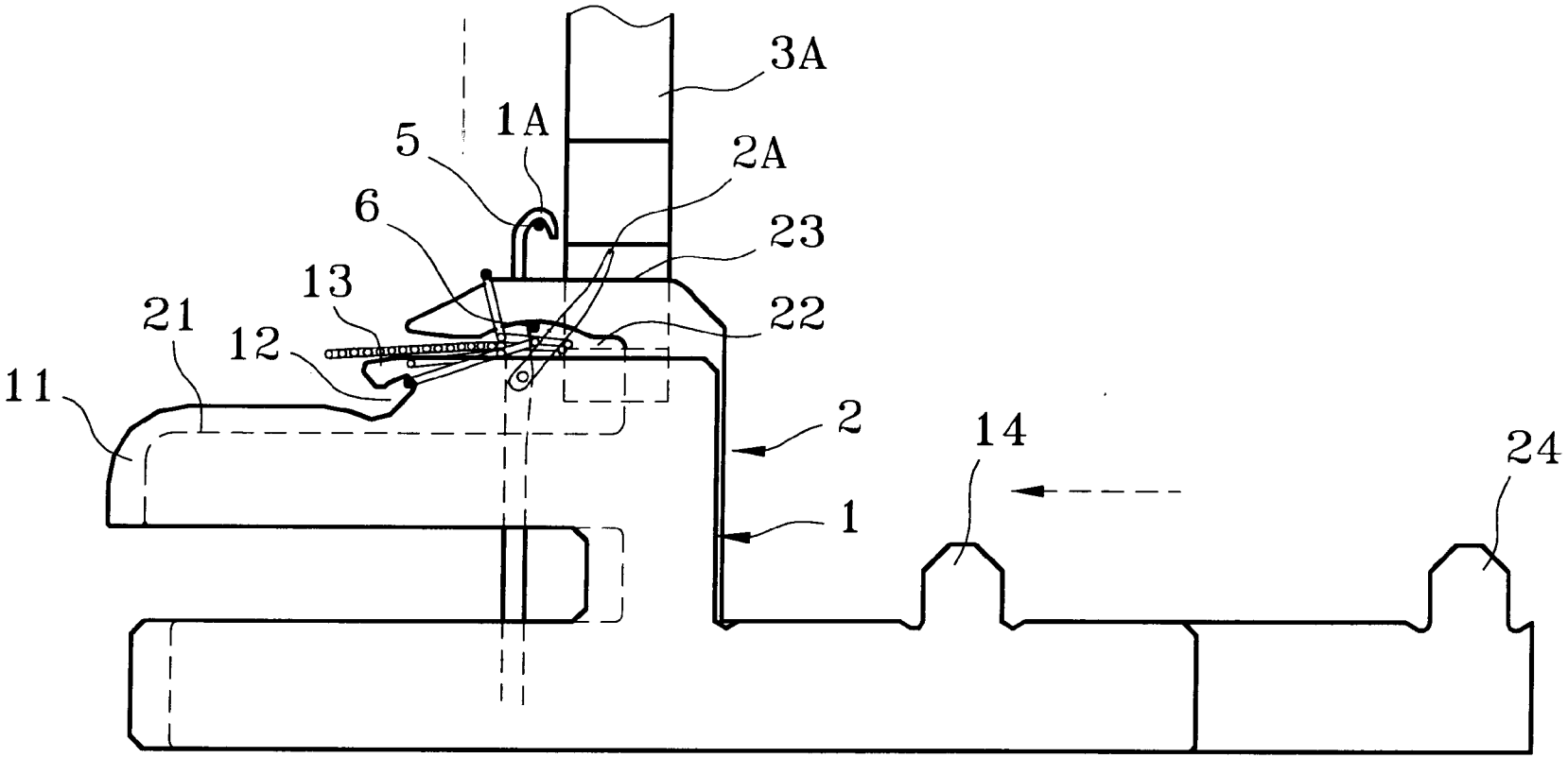
FIG. 9 is a schematic view of a fifth knitting step according to this invention.
Figure 10:
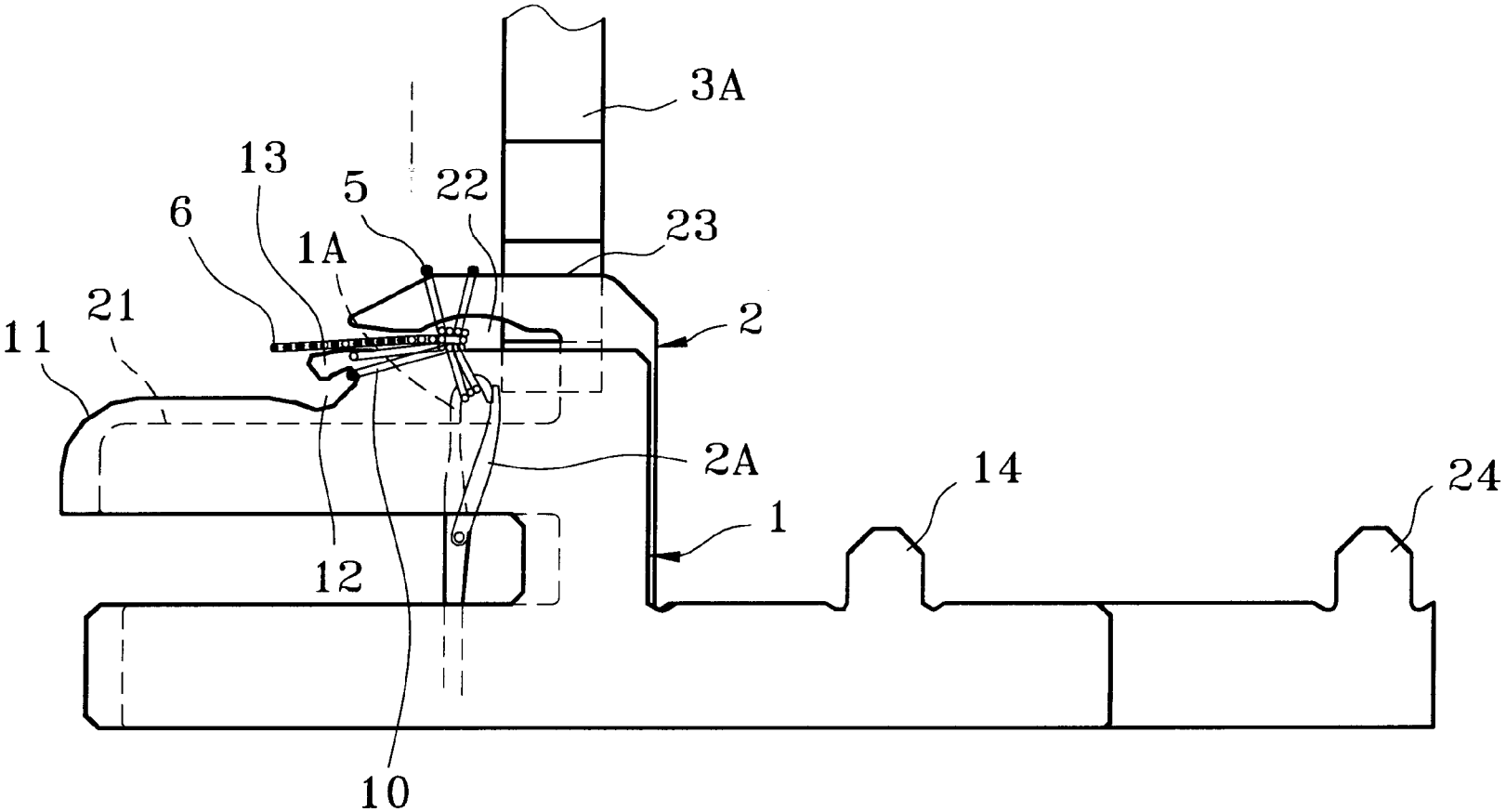
FIG. 10 is a schematic view of a sixth knitting step according to this invention.

Referring to FIGS. 1, 2, 3 and 4, the double-knitting plush fabric according to this invention is fabricated by using a ground yarn, two yarns and a novel sinker plate and upper needle dial (not shown in the drawings) for holding the sinker plate. The yarns are fed from different angles for knitting the double-side plush fabric desired.

The knitting means includes an outer sinker plate 1, an inner sinker plate 2 and a sinker ring 3 to drive the sinker plates 1 and 2.

The outer curl sinker plate 1 and inner curl sinker plate 2 are coupled together and held in a single slide groove of an upper needle dial (not shown in the drawings). The outer curl sinker plate 1 has a relatively thick first belly section 11, a first throat section 12 which has a relatively small inside diameter and a relatively short first nose section 13, and an extended first lug 14 located at a rear section thereof. The first throat section 12 and first nose section 13 are designed to make an outer curl 4 and a ground yarn 6 mating with a lower knitting needle (not shown in the drawings) for forming or releasing a loop.

The inner curl sinker plate 2 is coupled with the outer curl sinker plate 1 and to be held in the single slide groove of the upper needle dial (not shown in the drawings). The inner curl sinker plate 2 has a relatively thin second belly section 21, a second throat section 22 which has a relatively large inside diameter and a relatively long second nose section 23, and an extended second lug 24 located at a rear section thereof. The second nose section 23 is designed to make an inner curl 5 and ground yarn 6 mating with the lower knitting needle (not shown in the drawings) for forming or releasing a loop to smoothly engage the ground yarn 6 with the inner curl 5.

The sinker ring 3 has guiding paths 31 and 32 for driving respectively the outer curl sinker plate 1 and inner curl sinker plate 2 to fabricate a double-knitting plush fabric with loop effect at the outer and inner sides.

When this invention is in operation, the outer and inner curl inker plates 1 and 2 are moving in the normal paths of the sinker ring 3 to perform knitting operation. The operation includes the following steps (referring to FIG. 5 through 10):

At the first step (shown in FIG. 5), the knitting needle 1A picks up a sink loop, three yarns (4, 5, 6) in the needle hook are moved upwards with the needle 1A, the closing latch 2A is opened, the outer and inner curl sinker plate 1 and 2 are activated and moved forwards to press the old yarn loop from floating upward. The needle 1A continues rising. The latch 2A is opened completely before the yarn feeder 3A is entered to complete loop clearing operation. At this stage, the knitting needle 1A has reached the highest position. The outer and inner curl sinker plate 1 and 2 also complete fabric pressing operation and withdraw rearwards. In addition, the first throat section 12 of the outer curl sinker plate 1 presses the loop for a selected time period for the outer curl 4 to tie the ground yarn 6 more tightly.

At the second step (shown in FIG. 6), the knitting needle 1A starts lowering downwards to a yarn pick up position, the outer and inner curl sinker plate 1 and 2 withdraw rearwards until the yarns are completely away from the second throat section 22 of the inner curl sinker plate 2 and first nose section 13 and first throat section 12 of the outer curl sinker plate 1 for the yarn loop to slip in smoothly; the inner curl 5 slips in from the second nose section 23 of the inner curl sinker plate 2, the outer curl 4 slips in from the first throat section 12 of the outer curl sinker plate 1 to a specially designed sinker groove, then slips out from the sinker groove.

At the third step (shown in FIG. 7), the knitting needle 1A continues maintaining at a height level of one half of the same, the latch 2A is about 0.5 mm lower than the first belly section 11 of the outer curl sinker plate 1, the outer and inner curl sinker plate 1 and 2 continue move forwards to the position of the tucking loop, the needle hook picks up the yarn of the inner curl 5, the ground yarn 6 is picked up between the first nose section 13 of the outer curl sinker plate 1 and second throat section 22 of the inner curl sinker plate 2, and the yarn of the outer curl 4 is picked up by the first throat section 12 of the outer curl sinker plate 1.

At the fourth step (shown in FIG. 8), the outer curl sinker plate 1 moves forwards to form an outer loop, and the lower knitting needle stitches to form a piled loop.

At the fifth step (shown in FIG. 9), the inner curl 5 forms an inner piled loop through the tucking loop and sinking loop at the lower knitting needle 1A; as the fourth step has formed the piled loop, the lower knitting needle 1A will pick up sinking loop; the first throat section 12 of the outer curl sinker plate 1 feeds the yarn loop; after the sinker plate moves forwards for a selected time, the outer curl 4 will be loosened slightly for the lower knitting needle 1A to pick up the sinking loop easier.

At the sixth step (shown in FIG. 10), the lower knitting needle 1A tucks and sinks yarn loops to form the inner curl 5, outer curl 4 and ground yarn 6.

Figure 11:
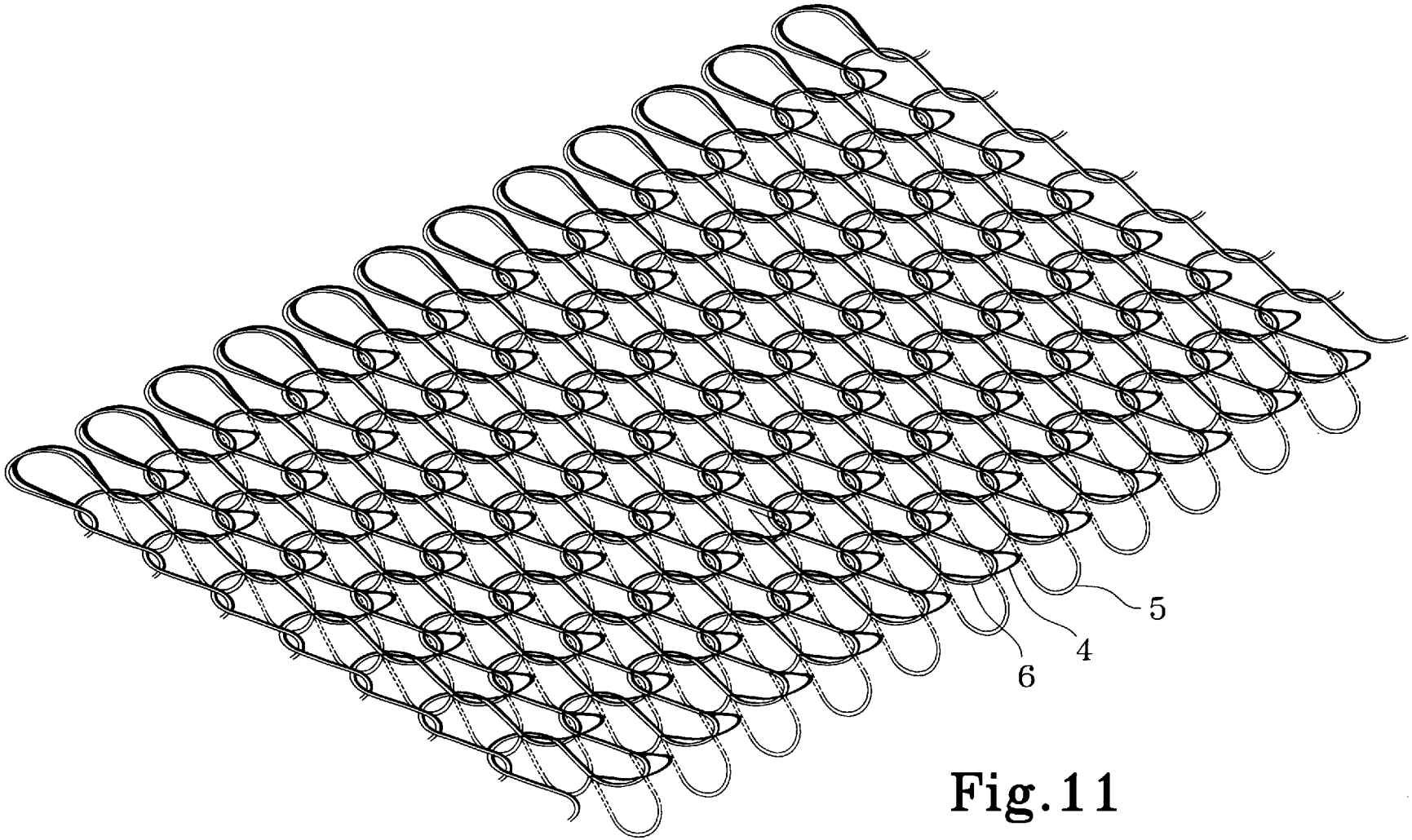
FIG. 11 is a pictorial view of a fabric of this invention.

At the seventh step (shown in FIG. 4), the knitting needle 1A has completed one loop and prepares for the next knitting cycle. At this time, the inner and outer curl sinker plate 2 and 1 move forwards to press the old loop. Hence through the coordination and control of the outer and inner curl sinker plate 1 and 2 and sinker ring 3, the resulting double-knitting plush fabric has loop effect at both the inner and outer sides (as shown in FIG. 11). It is a great improvement over conventional double-knitting plush fabric.

Figure 12:
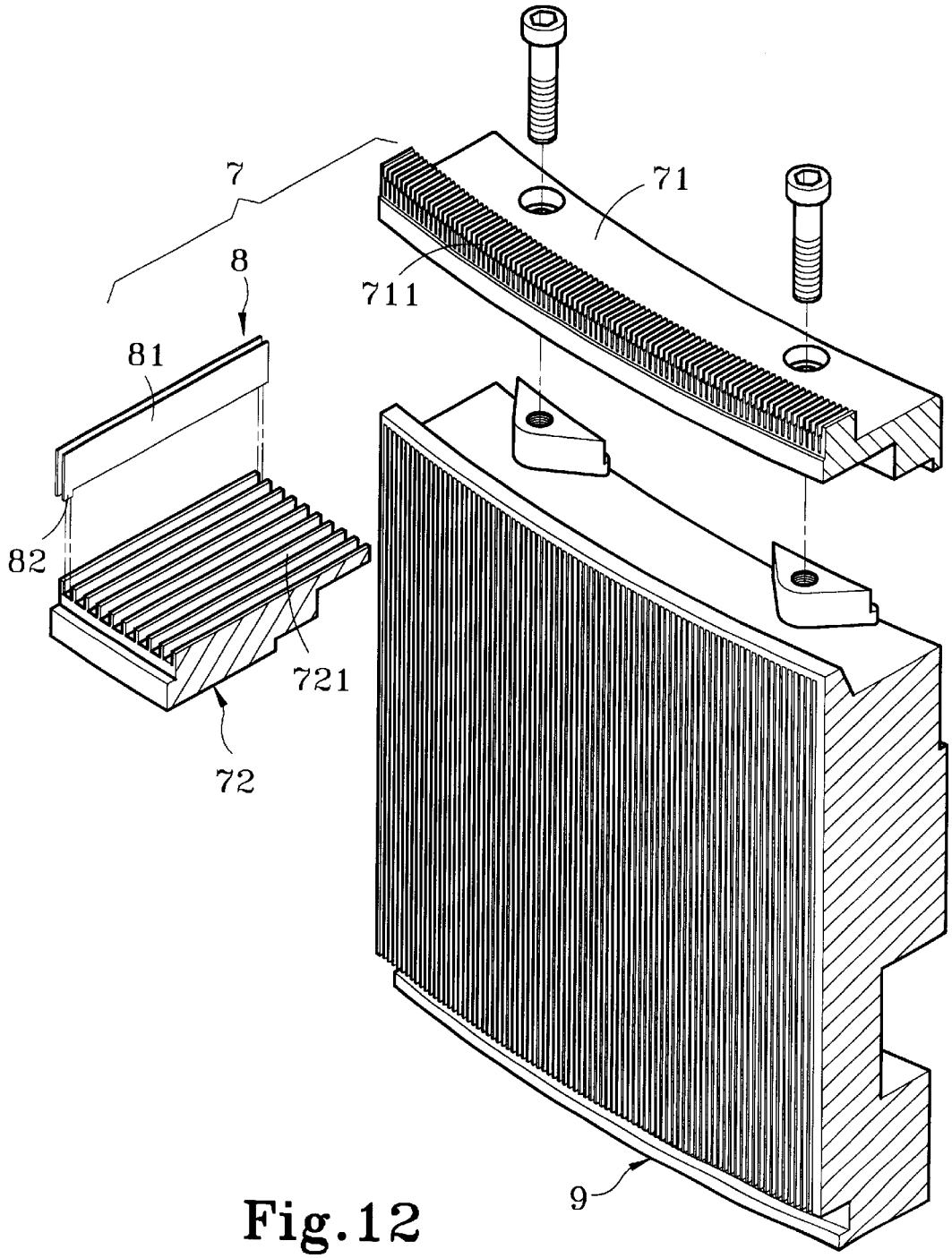
FIG. 12 is an exploded view of another embodiment of this invention.
Figure 13:
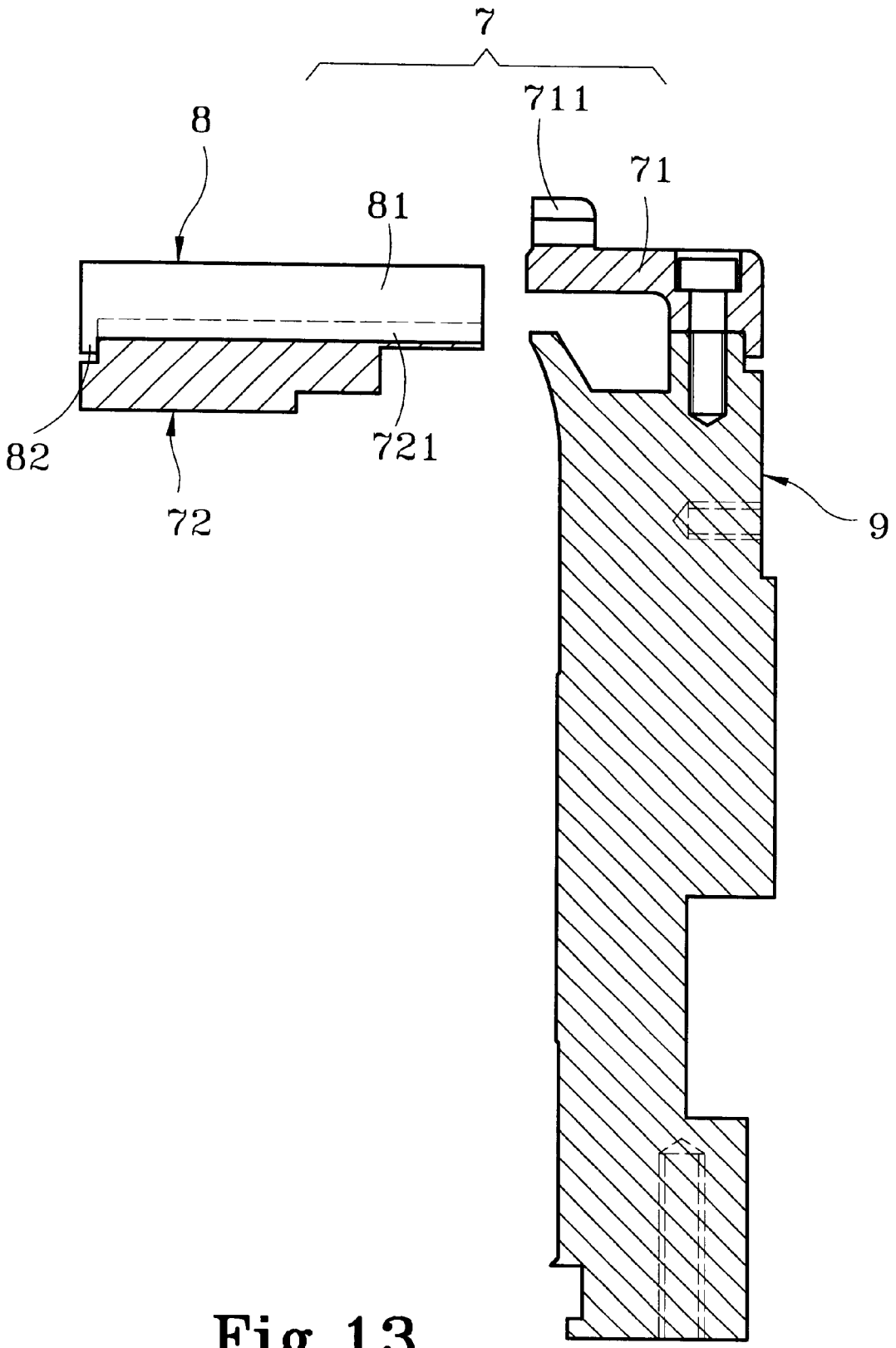
FIG. 13 is a sectional view of this invention, according to FIG. 12.

Referring to FIGS. 12 and 13, a jack 8 is provided to engage with an upper needle dial 7 to facilitate the smooth movement of the outer and inner curl sinker plate 1 and 2. The upper needle dial 7 includes a front section 71 and a rear section 72. The front section 71 is located above a needle drum 9 while the rear section 72 is located beneath the front section 71. The front and rear section 71 and 72 have respectively a slide groove 711 and 721 for the outer and inner curl sinker plate 1 and 2 to house and slide therein.

The jack 8 has two smooth lateral contact surfaces 81 and a blocking stub 82 at the rear end. The jack 8 engages to the slide groove 721 of the rear section 72 with the blocking block 82 located at the outer side thereof. The outer and inner curl sinker plate 1 and 2 are held in the jack 8 and have their outer sides contacting the surfaces 81. The jack 8 remains stationary when the outer and inner curl sinker plate 1 and 2 are driven by the sinker ring 3.

Figure 14:
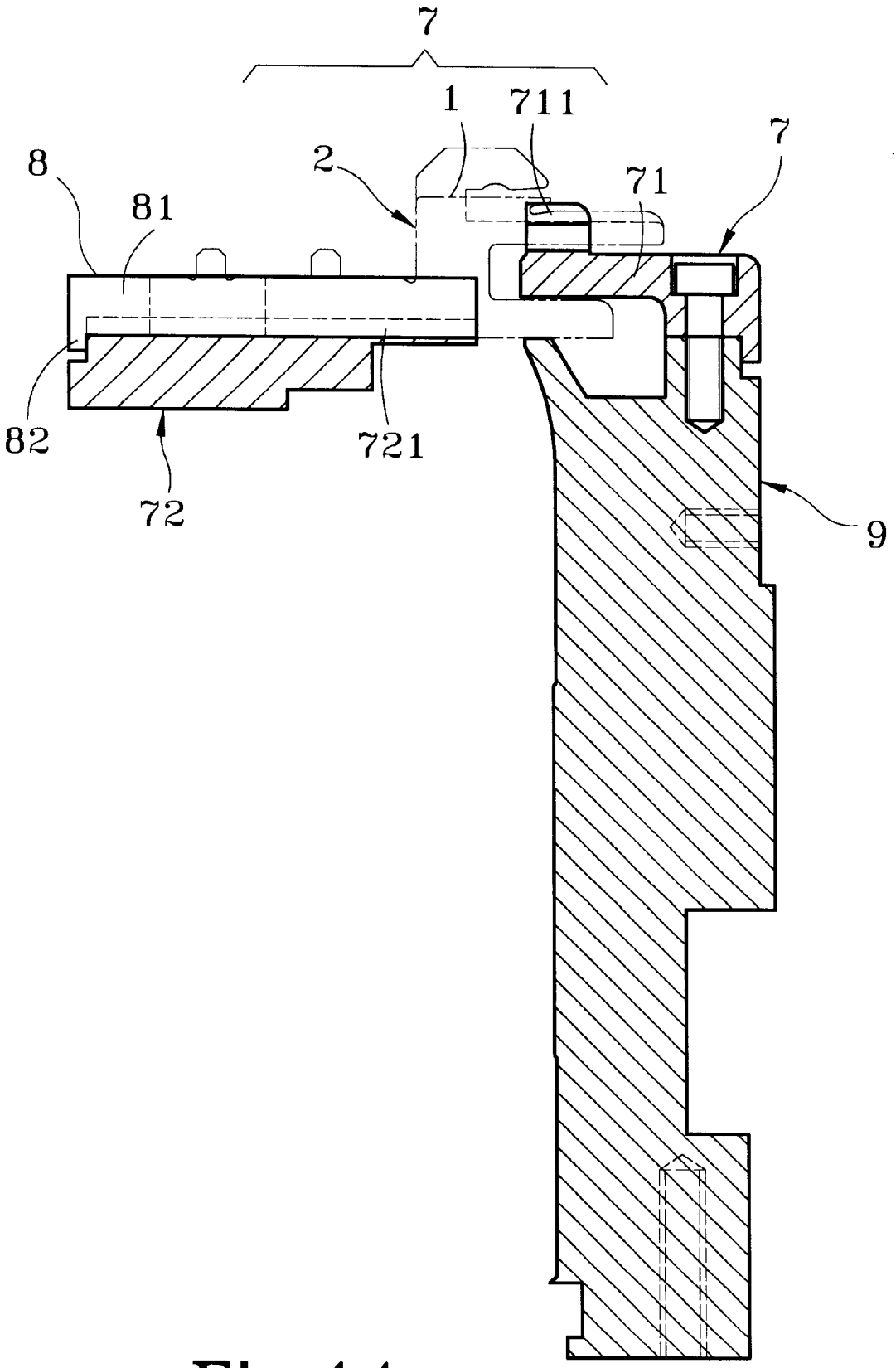
FIG. 14 is a sectional view of this invention in use, according to FIG. 12.
Figure 15:
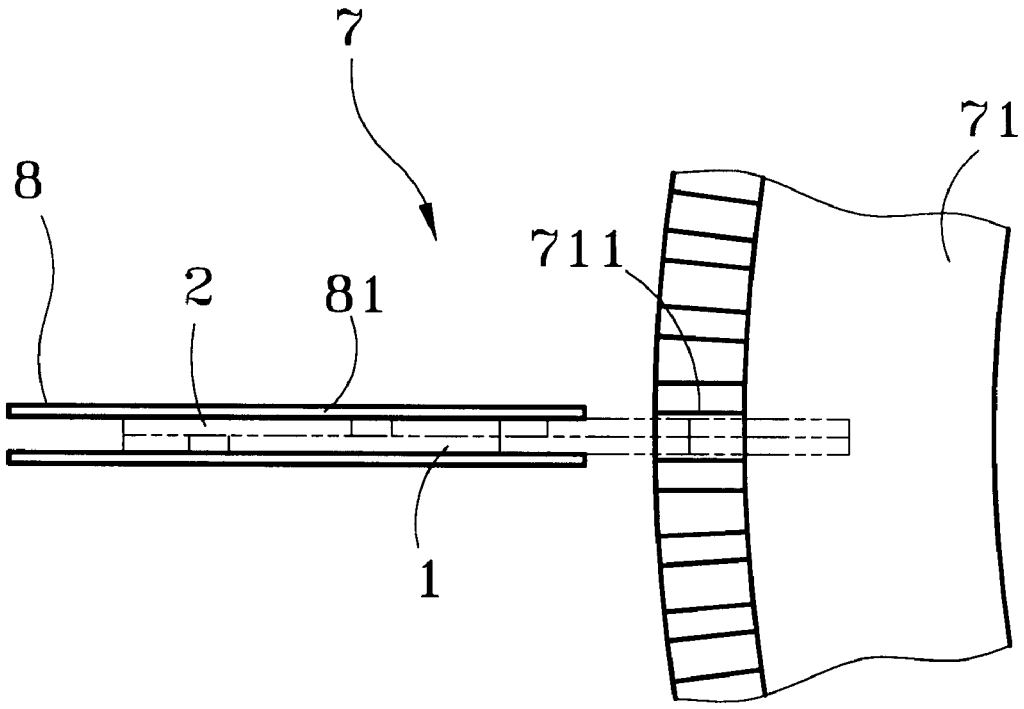
FIG. 15 is a schematic top view of this invention, according to FIG. 14.

Referring to FIGS. 14 and 15, as the jack 8 is engaged with the slide groove 721 of the rear section 72 of the upper needle dial 7, and has two smooth lateral contact surfaces 81 sandwiched the two outer sides of the coupled outer and inner curl sinker plate 1 and 2, the outer and inner curl sinker plate 1 and 2 may be moved outwards smoothly when driven by the sinker ring 3 for forming loops from the yarns.

Because of the outer and inner sinker plates 1 and 2 have smooth outer side surfaces, and the jack 8 also has smooth lateral contact surfaces 81, the outer and inner curl sinker plate 1 and 2 may be moved smoothly by the sinker ring 3 without hitting against one another, and therefore avoid damage from happening to the sinker ring 3 and outer and inner sinker plates 1 and 2.

What is claimed is:

1. A jack and upper needle dial for a circular knitting machine and double-knitting plush fabric fabricated by the same comprising an outer curl sinker plate, an inner curl sinker plate and an upper needle dial for holding the sinker plates to couple with a sinker ring to feed a ground yarn and two curl yarns at different angles for knitting the double-knitting plush fabric, wherein:

the upper needle dial includes a front section and a rear section which have respectively a slide groove for holding the outer and inner curl sinker plate;

the outer curl sinker plate coupled with the inner sinker plate to locate in the slide groove having a relatively thick first belly section, a first throat section of a relatively small inside diameter, a relative short first nose section, and a first lug located at a rear end thereof;

the inner curl sinker plate coupled with the outer curl sinker plate to locate in the slide groove having a relatively thin second belly section, a second throat section of a relatively large inside diameter, a relatively long nose section, and a second lug located at a rear end thereof;

the jack having two smooth lateral contact surfaces sandwiching two sides of the coupled outer and inner sinker plate and a blocking stub located at a rear end thereof, and being engaged with the rear section of the upper needle dial; and the sinker ring having guide paths for driving the outer and inner curl sinker plate to couple with a knitting needle to perform tucking and sinking loop operation for generating loop effect at both sides of the plush fabric and preventing the sinker ring and outer and inner curl sinker plate from hitting one another thereby to avoid damage of the sinker ring and outer and inner curl sinker plate.

* * * * *